US006457910B1

(12) United States Patent
Ludwig et al.

(10) Patent No.: US 6,457,910 B1
(45) Date of Patent: Oct. 1, 2002

(54) TUBULAR ANCHOR

(75) Inventors: Wolfgang Ludwig, Schwabmünchen; Erich Leibhard, Munich, both of (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/829,265

(22) Filed: Apr. 9, 2001

(30) Foreign Application Priority Data

Apr. 10, 2000 (DE) ..... 100 17 763

(51) Int. Cl.[7] ..... E21D 20/00; E21D 21/00

(52) U.S. Cl. ..... 405/259.1; 405/259.4; 405/259.6; 405/244; 405/269; 411/82; 411/258; 411/930; 52/155; 52/698; 52/704

(58) Field of Search ..... 405/259.1, 259.5, 405/259.6, 244, 269, 288, 302.1–302.3; 411/82, 82.1, 82.3, 258, 930; 52/155, 156, 158, 396.05, 543, 698, 704, 705, 706; 248/231.91, 573, 580, 925

(56) References Cited

U.S. PATENT DOCUMENTS 3,283,513 A * 11/1966 Kierans et al. ..... 405/259.5
4,055,051 A * 10/1977 Finney ..... 405/259.6
4,263,832 A * 4/1981 Lang et al. ..... 411/82 X
4,601,614 A * 7/1986 Lane et al. ..... 405/259.6
4,840,524 A * 6/1989 Bisping et al. ..... 411/82
5,666,779 A * 9/1997 Fuchs et al. ..... 52/705

FOREIGN PATENT DOCUMENTS

GB 2219816 * 12/1989 ..... 405/259.5
JP 56059916 * 5/1981 ..... 405/259.1

* cited by examiner

*Primary Examiner*—Heather Shackelford
*Assistant Examiner*—Jong-Suk Lee
(74) *Attorney, Agent, or Firm*—Sidley Austin Brown & Wood, LLP

(57) ABSTRACT

A tubular anchor includes a tubular member (1, 21) with a drilling head (2, 22) at one of its end, a load application element (3) extending along a portion of the tubular member opposite the one end, opening (5, 23) provided in a region of the drilling head. The tubular anchor also includes at least one, substantially cylindrical, hollow element (7, 24, 25) for receiving a mortar mass (4, 37, 38) and closed, at its opposite ends, with two displaceable pistons (8, 9; 31, 32, 33, 39), respectively, with one of the pistons being received in a piston-receiving region of the at least one mortar-mass receiving element and facing in a setting direction (S), (6, 35) and at least one through-opening (11, 34) spaced from a free end of the piston-receiving region (6, 35) by a distance (a, b) corresponding at least to a length (l) of the piston (8, 32) received therein.

9 Claims, 3 Drawing Sheets

TUBULAR ANCHOR

BACKGROUND OF THE INVENTION

1. Field of the Invention

The present invention relates to a tubular anchor such as, e.g., a roof bolt, used primarily in mine and/or tunnel construction and including a tubular member having a drilling head at one of its end, load application means at its other opposite end, at least one outlet opening provided in a region of the drilling head, and filled, at least partially, with one- or multicomponent mortar mass.

2. Description of the Prior Art

Tubular anchors of the type described above are generally known. They function primarily for stabilizing walls of hollow spaces such tunnels, galleries and the like. They are used primarily for securing to each other following each other, in a direction transverse to the wall, the wall-forming strata. In many cases, the mechanical characteristics of the layers, which like in immediate vicinity of the wall surface, in particular, their supporting resistance, changes as a result of formation of a hollow space. Therefor, these layers need be secured to further located undamaged or unaffected layers or strata.

A tubular anchor or a roof bolt of the above-described type is disclosed, e.g. in U.S. Pat. No. 4,055,051. The U.S. Patent discloses a roof bolt that is formed of a tubular element provided, at one of its end, with a drilling head and, at its opposite end, with load application means. The interior of the disclosed roof bolt is partially filled with mortar mass. An exit channel extends through the drilling head. The setting process of the disclosed roof bolt is elected in two steps. In the first step, the roof bolt forms, with the use of an available drilling too, a bore in the constructional component, in particular, in the ground. The drilled-of and commutated stone, which is produced upon drilling with the drilling head of the roof bolt, is removed through outlet openings provided in the drilling head and the space between the bore wall and the outer surface of the fastening element. In a second step, a piston, which is provided at an end of the roof bolt facing in the direction opposite to the setting direction, is advanced in the setting direction, pressing out the mortar mass, which fills the interior of the roof bolt, through the openings provided in the drilling head.

A drawback of the disclosed roof bolt consists in that a convenient handling and the reliability of the mortar mass, which is located in the roof bolt, cannot be always insured. Somewhat aggressive components of the mortar mass such as, e.g., amino-based, epoxy hardener can adhere to the inner elements of the roof bolt and, thereby, adversely affect its functioning.

Further, in the roof bolt of U.S. Pat. No. 4,055,051, complete squeezing of the mortar mass out of the tubular member, is not insured as the squeezing depends to a great extent on the setting tool used for setting the roof bolt. Therefore, it is, e.g. very difficult to determine the necessary amount of the mortar mass. This circumstance is further aggravated by the fact that the costs of the mortar mass form a substantial portion of the entire costs of the roof bolt.

Accordingly, an object of the present invention is to provide a tubular anchor in which almost complete extrusion of the mortar mass out is insured.

Another object of the present invention is to provide a tubular anchor which can be economically produced and which is easy to handle.

SUMMARY OF THE INVENTION

These and other objects of the present invention, which will become apparent hereinafter, are achieved by providing, in the tubular member, at least one, substantially cylindrical, hollow element for receiving a mortar mass and two pistons for closing the receiving element at its opposite ends and displaceable along the tubular member. The at least one receiving element has, at its end facing in a setting direction, a piston-receiving region for receiving the piston located at the facing in the setting direction end of the at least one receiving element and having at least one through-opening spaced from a free end of the piston-receiving region by a distance corresponding at least to a length of the piston received therein and measured in a longitudinal direction of the tubular member.

A pressure, which is applied from outside in the setting direction, displaces the mortar mass, which fills the space between the pistons in the mortar mass receiving element, in the setting direction. As the mortar mass-receiving element has a piston-receiving space, the piston, which is located at the facing in the setting direction end of the mortar mass-receiving means, can be displaced until it frees the through-opening providing in the piston-receiving region. The use of a sealing piston insures that the through-opening becomes open, with the application of a sufficiently high pressure, under any conditions. The tubular anchor according to the present invention can be economically produced because the manufacturing and assembly of a complicated mechanism of freeing the through-opening is not any more necessary. Storing of the mortar mass in a mortar mass-receiving element between two pistons insures a simple and reliable handling of the tubular anchor and, in particular, the handling of mortar mass. The pistons insure sealing of the mortar mass-receiving element and, thereby, storing of the mortar mass-receiving element, together with mortar mass, separately from the anchor. The receiving element can be inserted in the tubular anchor immediately before setting of the anchor. Thereby, the storage costs can be reduced, and a careful handling of the mortar mass is insured. Preferably, the-piston-receiving region has at least two through-opening uniformly distributed over a circumference of the piston-receiving region. This insures a uniform distribution of the mortar mass over the circumference of the anchor which permits the anchor to withstand increased load values. Advantageously, the drilling head has a diameter larger than a largest diameter of the tubular member. This insures formation of an annular slot in which a mixture of the mortar mass with drillings is received.

The outer diameter of the mortar mass-receiving element is preferably smaller than the inner diameter of the tubular member. This insures an easy insertion of the receiving element into the tubular member. Such design of the receiving element insures economical manufacture of the anchor. There is no need in additional elements or step for forming a channel between the tubular member of the receiving element. The foregoing insures an easy and reliable handling of the anchor. To insure placing of the mortar mass in the receiving means and to further simplify handling of the anchor, there is provided a hose-like bag for storing the mortar mass.

Advantageously, severally substantially hollow receiving elements are provided for placing the mortar mass into the tubular body. This permits to obtained a desired mixing ratio, when a multicomponent mortar mass is used, by selecting appropriate geometrical configurations of the receiving elements. In addition, a wall-free separation of separate components arranged one after another is insured. The use of several mortar mass receiving elements also facilitate storage of separate components of a multicomponent mortar mass.

Preferably, the several mortar mass-receiving elements are arranged one after another in the longitudinal direction of the tubular member. The annular cross-section of the receiving elements provides for convenient sealing of the element with appropriate sealing pistons. The arrangement of several mortar mass-receiving elements having annular cross-section one after another permits to avoid the use of additional relatively expensive elements or sealing solutions which do not insure a satisfactory sealing of the mortar mass-receiving elements.

According to the present invention each of the mortar mass-receiving elements is closed, at its opposite ends with respective pistons, with pistons, which are provided at ends of respective elements facing in the direction opposite the setting direction, being connected with each other. The adjacent pistons can be connected, e.g., by a one-piece piston rod. This permits to apply a uniform pressure to mortar mass components located in separate mortar mass-receiving elements during squeezing of the mortar mass out of the anchor. The mixing ratio of the separate components can be easily predetermined by selecting appropriate diameters of the mortar mass-receiving elements.

Advantageously, the mortar mass-receiving element or elements and the sealing pistons are formed of plastic materials. This permits to prevent deterioration of chemicals contained in a mortar mass. The chemicals come into contact with the mortar mass-receiving elements and the pistons, in particular, during the setting process.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
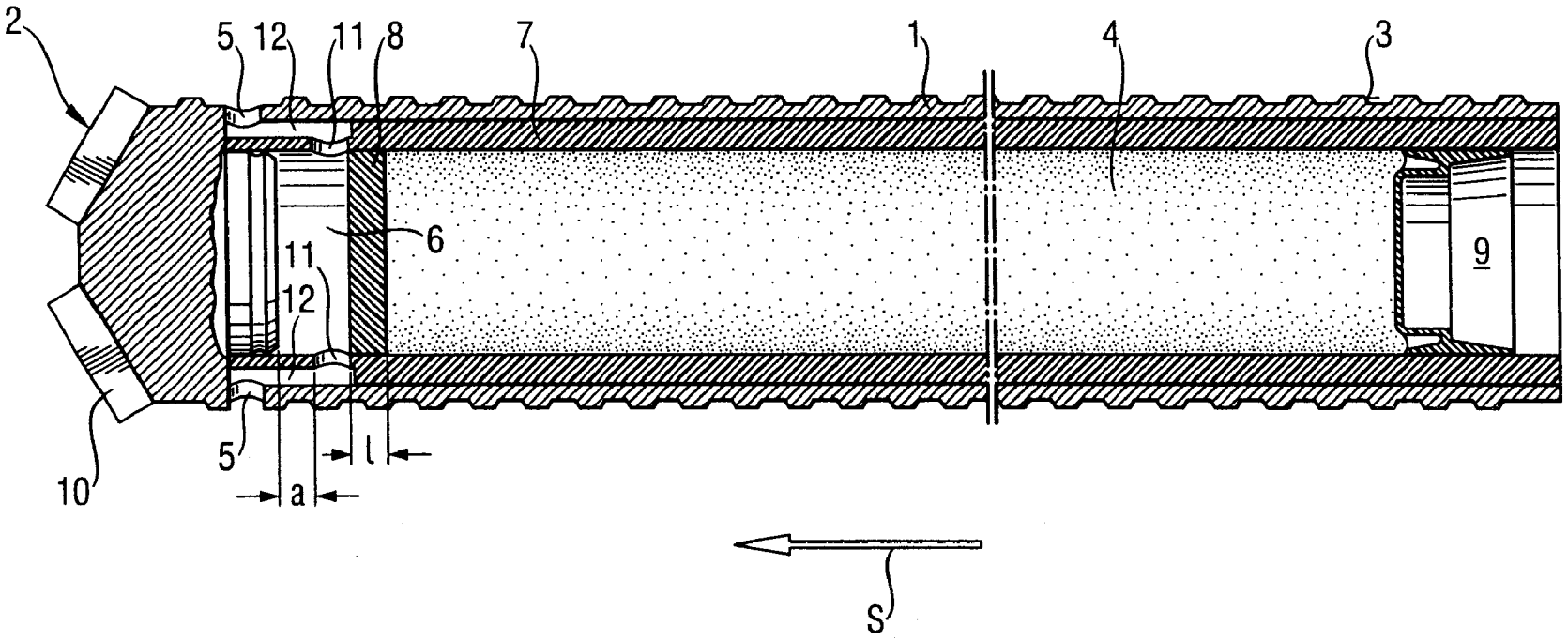
FIG. 1 a cross-sectional longitudinal view of a tubular anchor according to the present invention.
Figure 2:
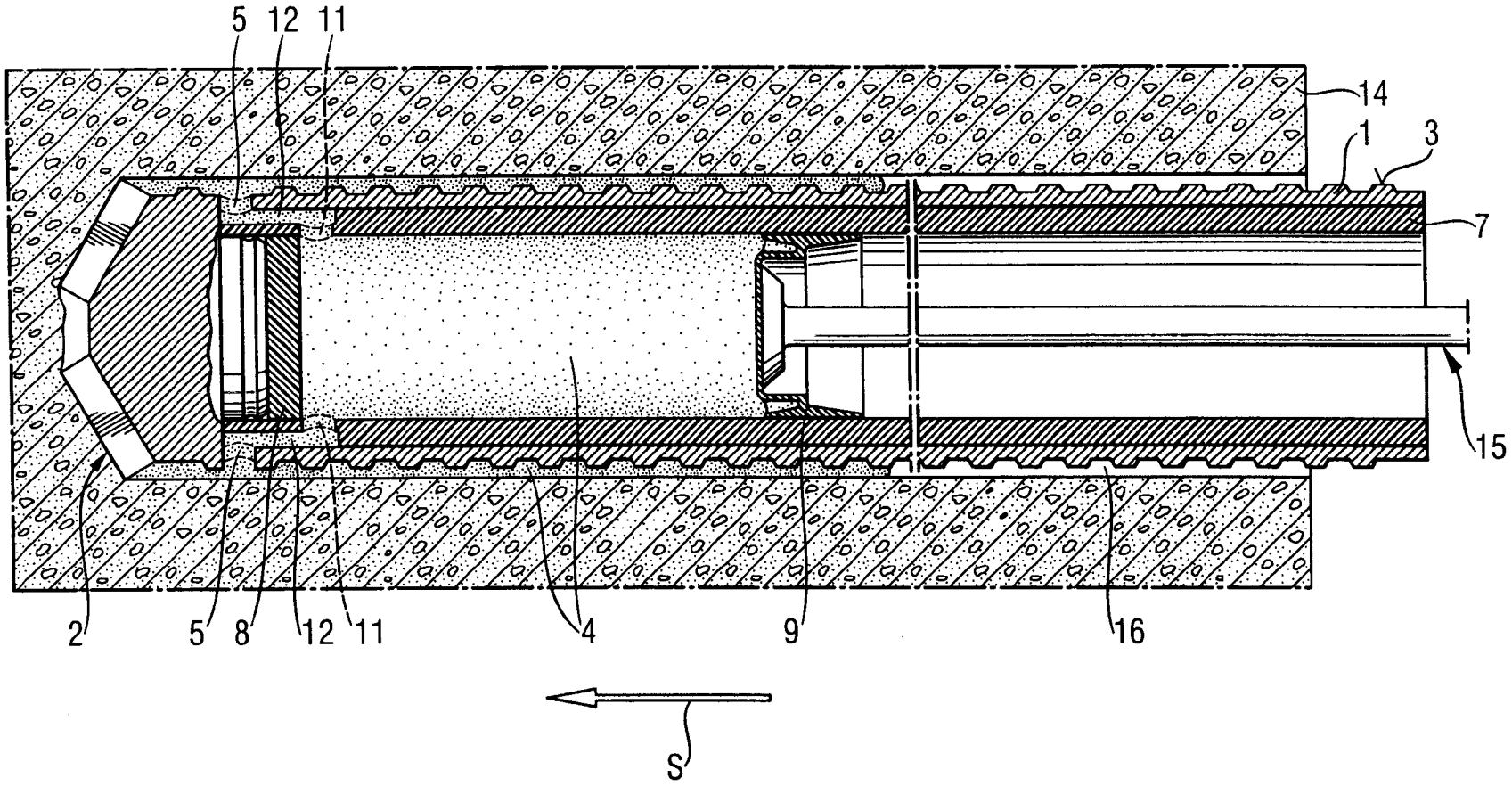
FIG. 2 a cross-sectional longitudinal view of the tubular anchor shown in FIG. 1 during the setting process.

A tubular anchor according to the present invention, which is shown in FIGS. 1–2, includes a cylindrical tubular member 1 inside of which receiving means 7 with a mortar mass 4 is arranged. The tubular member 1 is provided, at its end facing in setting direction, with a drilling head 2 and is provided, at its opposite end, with load application means 3 formed as a shaped profile.

The tubular member 1, which is formed, e.g., of metal, has at its end facing in the setting direction, one or several outlet openings 5 uniformly distributed over its circumference. The load application-forming shaped profile extends over the entire length of the tubular member 1. The shaped profile can be produced, e.g., by rolling.

The drilling head 2 has a conical tip the surface of which is provided with abrasive elements 10, e.g., hard metal particle, platelets and the like. To provide for removal of the drilling dust drillings the diameter of the drilling head 2 is selected greater than the diameter of the tubular member 1.

The mortar mass-receiving element 7 is formed of a plastic material and is closed at its opposite ends with pistons 8 and 9, respectively, longitudinally displaceable in the tubular member 1. In the setting direction, the piston 8 is adjoined by a region 6 what communicates with a plurality of radial through-openings 11 uniformly distributed over the circumference of the tubular member 1.

The through-openings 11 are spaced from the free end of the piston-receiving region 6 by a distance that corresponds at least to the length of the piston 8 measured in the longitudinal direction of the tubular member 1. The mortar mass 4 can, e.g., be packed in a bag not shown.

During the setting process, which is shown in FIG. 1, a rotational and translational movement is applied to the tubular anchor, e.g., by a drilling tool not shown. The drilling head 2 forms a bore 16 in the constructional component 14 for receiving therein the tubular member 1. When the desired setting depth is reach, an extrusion mechanism 15 applies pressure to the piston 9 located at the end of the tubular member 1 remote front the front end of the tubular member to displace the piston 9 in the setting direction S. Through the mortar mass 4, which is contained in the receiving element 7, the pressure is transmitted to the piston 8 located in the end region of the tubular member 1 facing in the setting direction S. The piston 8 is displaced in the setting direction until it is completely located in the receiving region 6, freeing the through-openings 11 so that the mortar mass 4 can flow therethrough. With the pressure being applied to the mortar mass 4, it exits the through-opening 11 and flows, through a channel 12 toward the outlet openings 5 where it intermixes with the drillings. The mortar mass 4, which is now mixed with the drillings and is extruded through the openings 5 becomes evenly distributed, as a result of the pressure, still applied thereto, in the space between the wall of the bore 16 formed in the constructional component 14 and the outer surface of the tubular member 1.

Figure 3:
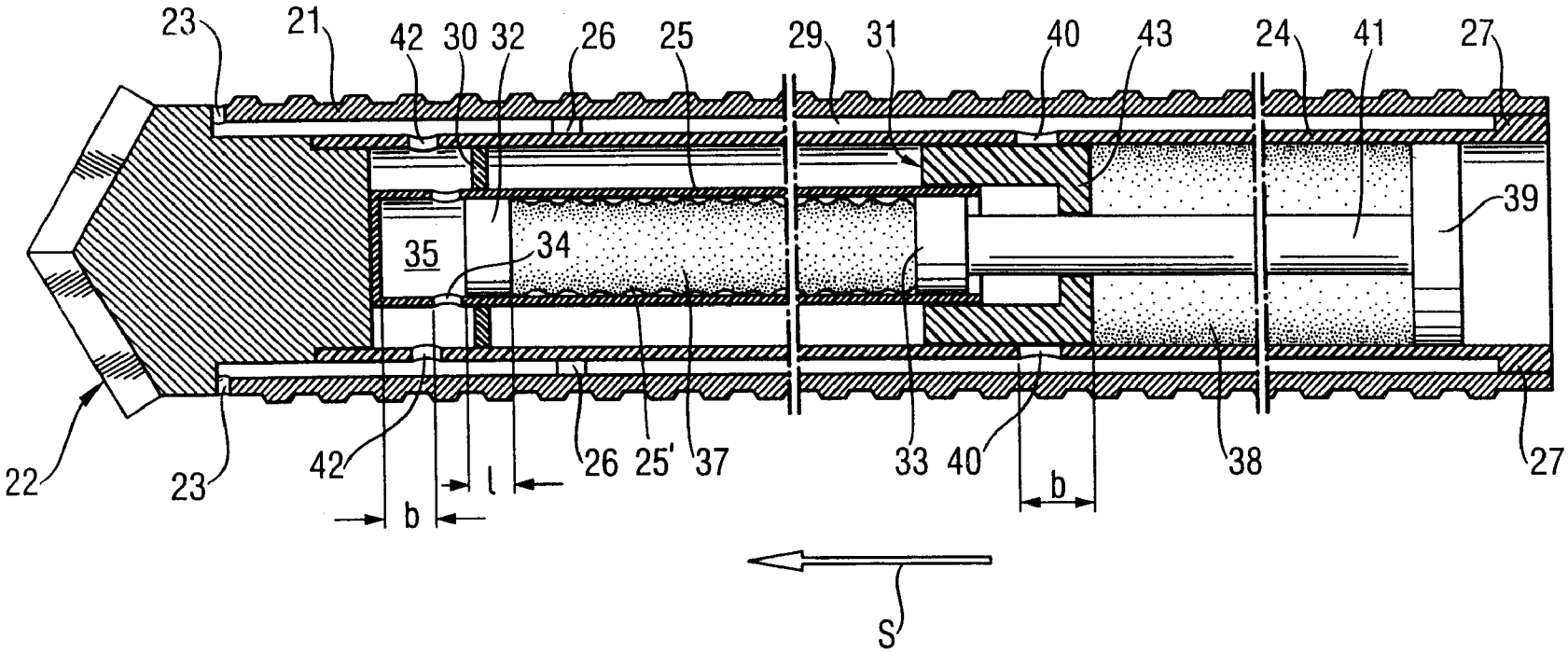
FIG. 3 a cross-sectional longitudinal view of another embodiment of a tubular anchor according to the present invention

FIG. 3 shows another embodiment of a tubular anchor according to the present invention. The tubular anchor, which is shown in FIG. 3 has a drilling head 22 and a tubular member 21 provided in its facing in the setting direction, end region with a plurality of outlet openings 23. Contrary to the embodiment of the tubular anchor shown in FIGS. 1–2, the tubular member 21 includes a plurality of mortar mass-receiving elements and, specifically, two receiving elements 24, 25. This tubular anchor can be used with a multicomponent mortar mass. Each component 37, 38 can be received in respective receiving means 24, 25 arranged between two respective sealing pistons 32, 33 and 31, 39.

The first receiving means 24 are centrally arranged in the tubular member 21 in a fixed position with an aid of spacers 26, 27. The spacer 27, which is provided at an end of the tubular member 21 facing in the direction opposite to the setting direction is formed as a flanged sealed between the outer surface of the first receiving element 24 and the inner wall of the tubular member 21. The second spacer 26, which is located in the end region of the tubular member 21 facing in the setting direction S, does not extend over the entire circumference of the receiving means 24, whereby a longitudinal channel 29 between the two spacers 26, 27 is able to communicate with the outlet openings 23.

The second receiving element 25, which are located within the first receiving element 24, is centrally held therein with a flange 30 and pot-shaped piston 31. Both the flange 30 and the piston 31 are located between the inner wall of the first receiving element 24 and the outer wall of the second receiving means 25. The second receiving element 25 is formed shorter than the first receiving element 24.

The second receiving element 25 is formed, e.g., of a plastic material and is closed at its opposite ends with the pistons 32, 33 longitudinally displaceable in the tubular member 21. The piston 32 is adjoined, in the setting direction, by a piston-receiving region 35 with a plurality of openings 34 uniformly distributed over the circumference of the piston-receiving region 35. The openings 34 are spaced from the free end of the piston-receiving region 35 by a distance b which corresponds at least to the length l of the piston 32 measured in the longitudinal direction of the tubular member 22. Further, the piston 31, which is located at the end of the second receiving element 25 facing in the direction opposite to the setting direction S, projects above the second receiving means at least by a distance $b^1$. The mortar mass component 37, which is located in the second receiving element 25, can be packed, e.g, in a hose-shaped bag $25^1$.

The first receiving element 24, which has a cylindrical shape, can be formed, e.g., of a plastic material. The end of the first receiving element 24 which faces in the direction opposite to the setting direction, is closed, as it has already been discussed above, by the piston 39 which is connected with the piston 33 by a piston rod 41. The opposite, facing in the setting direction, end of the first receiving element 24 is closed by the bottom 43 of the pot-shaped piston 31 displaceable along the tubular member 21. The bottom 43 sealingly surrounds the piston rod 41. The tubular member 1 has at least one opening 40, which is spaced from the bottom 43 of the pot-shaped piston 31 in the setting direction S by a distance ($b^1$). The first receiving member 24 is also provided with further openings 42 spaced, in the setting direction S, from the flange 30. The openings 42 are arranged radially symmetrically with respect to the longitudinal extent of the tubular member 21.

During the setting process, a drilling tool (not shown) impacts the tubular anchor rotational and translational movements, and the drilling head 22 forms a bore in a constructional component in which the anchor is received. After the anchor reaches a predetermined depth, a pressure is applied to the piston 39, and the piston 39, together with the piston 33 connected with the piston 39 by the piston rod 41, are displaced in the setting direction S, applying pressure to the mortar mass components 37, 38 filling the first and second receiving element 24, 25 respectively. With this, the pistons 31, 32 are also displaced in the setting direction S. As soon as the pistons 31, 32 move past the respective openings 40, 42, the respective mortar mass components 37, 38 are squeezed out, under the pressure still applied to the piston 39, from the first and second receiving means 24, 25 through the openings 40, 42. The squeezed out mortar mass components 37, 38 move in the channel 29 toward the outlet openings 23. Due to the rotational movement of the anchor, the separate components 37, 38 intermix in the region of the drilling head 22. The rotational movement of the anchor and the pressure applied to the piston 39 cause displacement of the intermixed mortar mass into the space between the wall of the bore formed in the constructional component and the outer surface of the anchor. Upon hardening of the mortar mass, a durable and reliable connection of the anchor with the constructional component is provided.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A tubular anchor, comprising a tubular member (1, 21) having a drilling head (2, 22) at one end thereof, load application means (3) extending along a portion of the tubular member opposite the one end thereof, and at least one outlet opening (5, 23) provided in a region of the drilling head; at least one, substantially cylindrical, hollow element (7, 24, 25) for receiving a mortar mass (4, 37, 38); and two pistons (8, 9, 31, 39, 32, 33), for closing the at least one mortar mass-receiving element (7, 24, 25) at opposite ends of the at least one mortar mass-receiving element (7, 24, 25) and displaceable along the tubular member (1), the at least one mortar-mass receiving element (7, 24, 25) having, at an end thereof facing in a setting direction (S), a piston-receiving region (6, 35) for receiving a respective one of the two pistons (8, 32) and having at least one through-opening (11, 34) spaced from a free end of the piston-receiving region (6, 35) by a distance (a, b) corresponding at least to a length (l) of the piston (8, 32) received therein and measured in a longitudinal direction of the tubular member.

2. A tubular anchor according to claim 1, wherein the piston-receiving region (6, 35) has at least two through-openings (11, 34) uniformly distributed over a circumference of the piston-receiving region.

3. A tubular anchor according to claim 1, wherein the drilling head (2, 22) has a diameter larger than an outermost diameter of the tubular member (1, 21).

4. A tubular anchor according to claim 1, wherein the at least mortar mass-receiving element (7, 24, 25) has a diameter smaller than a diameter of the tubular member (1, 21), whereby a channel (12, 29) is formed therebetween.

5. A tubular anchor according to claim 1, further comprising at least one hose-shaped bag arranged in the at least one mortar mass-receiving element (7, 24, 25) for holding the mortar mass (4, 37, 38).

6. A tubular anchor according to claim 1, wherein the at least one mortar-mass receiving element comprise a plurality of substantially cylindrical, hollow elements (24, 25) for receiving the mortar mass (37, 38).

7. A tubular anchor according to claim 6, wherein the plurality of mortar mass receiving elements are formed as a respective plurality of mortar mass-receiving containers arranged one after another in a longitudinal direction of the tubular member (21).

8. A tubular anchor according to claim 7, wherein each of the mortar mass-receiving containers is closed, at opposite ends thereof, with respective pistons the pistons facing in the direction opposite the setting direction, being connected with each other.

9. A tubular anchor according to claim 1, wherein the at least one mortar mass-receiving element and the two pistons are formed of a plastic material.

* * * * *